US005655270A

United States Patent [19]

Boisvert

[11] Patent Number: 5,655,270

[45] Date of Patent: Aug. 12, 1997

[54] FLEXIBLE, DOUBLE ENDED CLIP USED FOR ATTACHING IDENTIFICATION TO CLOTHING

[76] Inventor: Rene G. Boisvert, 484 Lake Park Ave. #246, Oakland, Calif. 94610

[21] Appl. No.: 463,719

[22] Filed: Jun. 5, 1995

[51] Int. Cl.[6] ..... A44C 3/00; A41F 1/00

[52] U.S. Cl. ..... 24/336; 24/301; 24/339; 40/1.5

[58] Field of Search ..... 24/339, 338, 335, 24/13, 18, 301, 304, 67.9; 40/1.5, 633

[56] References Cited

U.S. PATENT DOCUMENTS

| | | | |
|---|---|---|---|
| 202,735 | 4/1878 | Lindsay | 24/301 |
| 220,680 | 10/1879 | Strickrodt | 24/301 |
| 240,471 | 4/1881 | Smith . | |
| 306,417 | 10/1884 | Moseley | 24/301 |
| 1,782,057 | 11/1930 | Bollinger | 24/301 |
| 1,804,308 | 5/1931 | Bollinger . | |
| 3,054,201 | 9/1962 | Burns | 40/105 |
| 3,126,600 | 3/1964 | De Marre . | |
| 3,193,842 | 7/1965 | Bell . | |
| 4,115,906 | 9/1978 | Lavine et al. | 24/301 |
| 4,148,114 | 4/1979 | Wier | 24/67.9 |
| 4,253,216 | 3/1981 | Brown . | |
| 4,388,770 | 6/1983 | Manor . | |
| 4,707,906 | 11/1987 | Posey | 24/339 |
| 4,839,947 | 6/1989 | Cohen et al. | 24/499 |
| 5,117,538 | 6/1992 | Henry | 24/301 |
| 5,142,807 | 9/1992 | Sweet . | |
| 5,377,391 | 1/1995 | Foster | 24/301 |

FOREIGN PATENT DOCUMENTS

| | | | |
|---|---|---|---|
| 0109050 | 11/1939 | Australia | 24/339 |

*Primary Examiner*—Victor N. Sakran

[57] ABSTRACT

A double ended clipping device used for attaching assorted types or sizes of identification at one end and for attaching to various clothing types at the other end.

1 Claim, 1 Drawing Sheet

FLEXIBLE, DOUBLE ENDED CLIP USED FOR ATTACHING IDENTIFICATION TO CLOTHING

BACKROUND/FIELD OF INVENTION

The present invention generally relates to identification holders/badges, specifically to such identification holders/badges which hold business ID, business cards, or event ticket stubs to one's clothing for purposes of convenient display of such ID.

BACKROUND/DESCRIPTION OF PRIOR ART

Many businesses, trade shows, sporting and entertainment events require proper identification for easy ingress/egress to specific locations within their building or facility. A recurring problem for individuals trying to obtain access is the need to retrieve their ID from their pocket, wallet, purse, or briefcase to present to security personnel, ushers, etc.. In order to conveniently verify an individual's identification (most often a flat, rigid two dimensional item similar to a driver's license, business card, or ticket stub), the individual will attach their identification to their clothing. Prominent display of information allows identification to be made expediently. Such an identification allows an easier, quicker, and more efficient way to manage an individual's access to designated areas. Increased speed of verification of identification adds to the convenience and enjoyment of the identification wearer's experience while his or her identification is being verified.

The existing products generally have an identification holder that forms a semi-permanent part of the identification holder's badge or clothing. Such identification holders do not allow for the convenience of immediately being able to attach one's ID. For example, using the presently available devices, a businessperson upon entering a trade show cannot immediately and conveniently attach a business card. Likewise, a sports fan upon entering a ballpark cannot immediately and conveniently attach his or her ticket stub to his or her clothing.

The presently used devices do not provide for convenient reuse. For example, insertion or use of a new business card or a ticket stub for another event.

Additionally, the presently used devises do not offer a surface that is suitable or readily available for the reception of print or labeling. Likewise, the currently used devises are not readily color codeable. The advantage of having a surface available for print is to allow advertisers or sponsors to put their name, logo, or message on the holders in such a way that it will be readily readable to all attendees or observers. The advantage of color coding is to be able at a glance to verify information about the event, for example, the color could indicate access on a certain date or dates or access to certain areas within the facility.

In a previously completed patent search, no "close" references were found.

The device disclosed in Registration U.S. Pat. No. 5,117,538 (1992) is used to secure suspender shoulder straps.

Double ended clips are disclosed in Registration U.S. Pat. Nos. 202,735 (1878); 220,680 (1879); 240,471 (1881); 1,782,057 (1930); 1,804,308 (1931); and 3,126,600 (1964). Each of the aforesaid patents discloses fastening devices designed for the adjustment or alteration of how clothing is worn for more comfort or convenience. Registration U.S. Pat. No. 5,142,807 (1992) discloses a double ended gripping device used for fishing purposes.

Registration U.S. Pat. Nos. 3,193,842 (1965); 4,253,216 (1981); 4,388,770 (1983); and 4,869,004 disclose devices that enable a wearer to display identification.

Although the patents discussed herein relate to attaching identification to a wearer, the inventions disclosed therein suffer from a number of disadvantages.

(a) One end of the gripping device disclosed in Registration U.S. Pat. No. 3,193,842 must be sewn into one's jacket sleeve pocket. This is a permanent attachment that takes time and effort to put to use. The device is limited to the use with the specific jacket type apparel to which the clip is attached. The device is completely unusable at a convention or sporting/entertainment event, unless the participant is wearing the particular item of apparel.

(b) Use of adhesive is a key element of the disclosed device in Registration U.S. Pat. No. 4,253,216. It is necessary to replace used adhesive portions of the device. The cost of product is increased because of the need to buy replacement parts.

(c) The device disclosed in Registration U.S. Pat. No. 4,388,770 uses a transparent pocket sleeve as a key element. Multiple steps must be executed to construct the specific embodiment thus making it inconvenient to use quickly and immediately. The device disclosed is specifically designed for contestants in sporting and athletic contests, and is large and cumbersome.

(d) Use of a transparent pocket sleeve is a key element of the device disclosed in Patent Registration No. 4,869,004. A safety pin type device is used for attaching to clothing. The attachment device disclosed in this patent is inconvenient to attach, difficult to attach attractively, and puts holes in the wearer's clothing. This type of device is especially difficult to use with certain materials such as leather or suede.

(e) Use of paper thin plastic materials such as those used with the devices disclosed in Registration U.S. Pat. Nos. 4,388,770 and 4,869,004 for pocket sleeves become brittle over time and crack or can easily tear. Reuse of such devices is minimal. Because of the need to replace these devices on a regular basis, the cost of use is high.

(f) The inventions disclosed in the above referenced patents cannot be produced in colors.

(g) Above referenced inventions do not lend themselves to allow printing on their surfaces.

OBJECTS AND ADVANTAGES

Several objects and advantages exist for the present invention:

(a) to provide a holding device that has a main strap with two ends and two clips, one clip being located on each end of the main strap and wherein one clip is attached to the top surface of the strap and a second clip is attached to the bottom or opposite surface of the strap. Such features allow the clips to lay flat against the wearer's body for a more attractive and convenient display of the wearer's identification.

(b) to provide a holding device that has two clips that are able to rotate 360 degrees. The 360 degree rotation feature gives the device the ability to adapt to different types of clothing (shirt, coat, sweater, hat, etc.), offers different options of where the device can be attached (pocket, belt, collar, lapel, etc.) and at what angle the device is attached to the wearer's clothing.

(c) to provide a holding device that is flexible and durable in construction.

(d) to provide a holding device that is capable of being produced in multiple colors.

(e) to provide a holding device that is reusable and is suitable for use by men, women, children and teenagers.

(f) to provide a device which can be conveniently and easily used for its designated purpose.

(g) to provide a holding device that has a specially treated surface on the clip portions so that the clips are not slippery when handled with wet or greasy fingers.

(h) to provide a holding device that has a base strap with a flat surface suitable for the reception of labeling or printing.

(i) to provide a holding device that is relatively inexpensive to manufacturer.

(j) to provide a holding device that is self contained and that needs no pre-construction by the user and requires no other elements for use, for example, sewing, adhesive, or the like.

Still further objects and advantages will become apparent from a consideration of the ensuing description and drawings.

DRAWING FIGURES

DESCRIPTION & OPERATIONS/FIGS. 1–3

Figure 1:
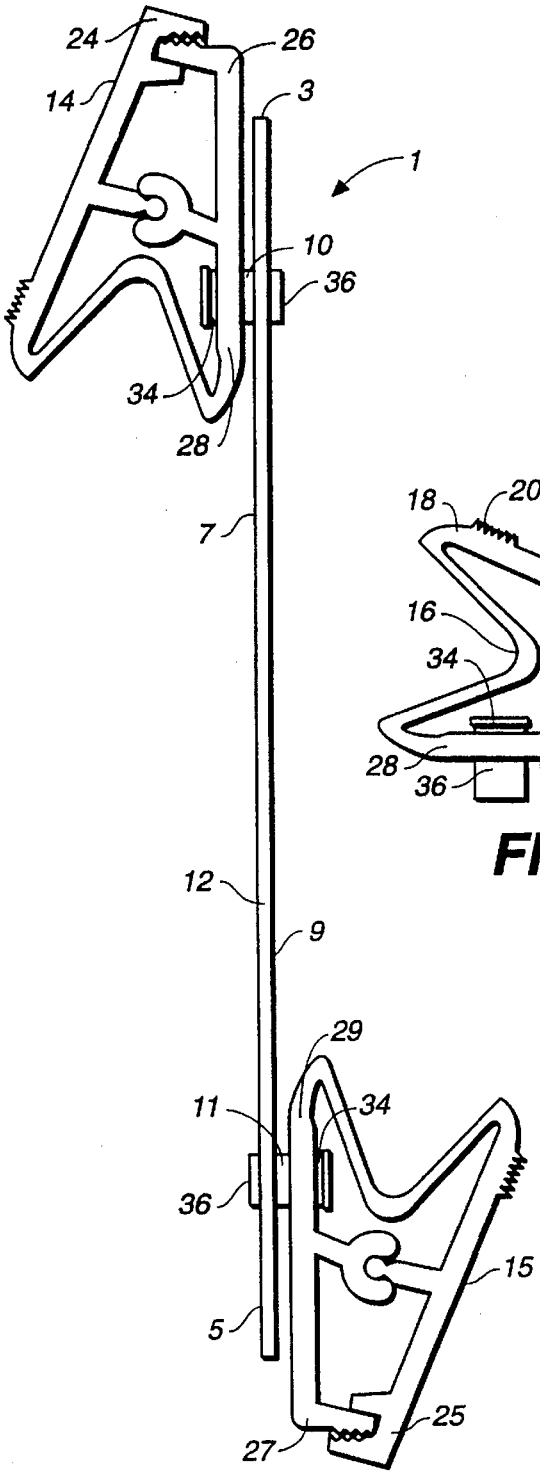
FIG. 1 is a side view of the holding device of the present invention with two rotatable clips attached on opposite ends and opposite sides to a flexible base strap.
Figure 2:
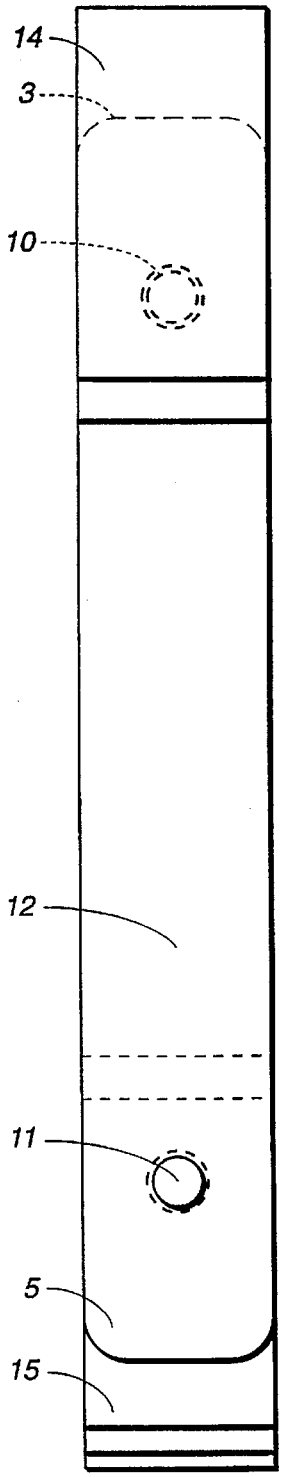
FIG. 2 is a top view of the device which illustrates the means for connecting the rotatable clips to the base strap.

A typical embodiment of a double ended holding device one is illustrated in FIG. 1. The holding device 1 has a base strap 12 preferably made of flexible material which can be bent and straightened out without fracturing. Holding device 1 as shown in FIG. 1 has a first end 3 and a second end 5. The base strap 12 also has a first surface 7 and a second or opposing surface 9, As shown in FIG. 1 holding device 1 has a first clip 14 and a second clip 15. First clip 14 is attached to and protrudes from or sits above first surface 7 proximate to first end 3 such that upper gripping jaw 24 protrudes beyond end 3 when first clip 14 is aligned over the surface 7 of strap 12. Second clip 15 is attached to and protrudes from or sits above second surface 9 proximate to second end 5 such that upper gripping jaw 25 protrudes beyond end 5 when second clip 15 is aligned over the surface 9 of strap 12. The clips 14 and 15 are preferably fully rotatable and are attached to the base strap 12 by connecting rivets each with a first end 34 and a second end 36. The first end of each rivet is respectively attached through first and second finger levers 28 and 29 of the rotatable clips 14 and 15 and through the base strap 12. The second end 36 of each rivet is attached through the base strap 12 proximate to first end 3 and second end 5 respectively, In the preferred embodiment, the base strap 12 and the rotatable Clips 14 and 15 are made of flexible plastic, FIG. 2 offers an additional view that shows that the rotatable clips 14 and 15 are attached to opposite ends of the base strap 12 and clearly shows two respective clips 14 and 15 are attached to the base strap 12 by two rotatable connecting means 10 and 11 which respectively protrude from the rotatable clips 14 and 15. Each clip 14 and 15 respectively is attached to the base strap 12 proximate to ends 3 and 5 respectively such that the first and second upper gripping jaws of clips 14 and 15 extend beyond ends 3 and 5 respectively of base strap 12.

Figure 3:
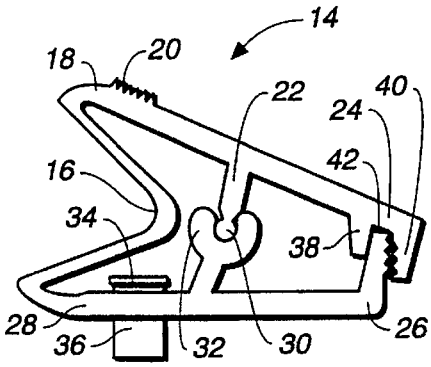
FIG. 3 is a side view of a clip which illustrates a springlike hinge, gripping grooves, and upper and lower finger levers and gripping jaws.

FIG. 3 is a side view of a rotatable clip 14 of the present invention. The clip has upper finger lever 18 attached at one end to one end of hinge 16. A second end of hinge 16 is attached to lower finger lever 28. Clip 14 is operable by pinching or squeezing the upper finger lever 18 and the lower finger lever 28 similtaneously to disengage the upper gripping jaws 24 and lower gripping jaw 26. The pinching action exerted on the upper and lower finger levers sets hinge 16 and pivotal axis 22 of the clip 14 assembly into motion which allows for the upper 24 and lower gripping jaws 26 to seperate. While the jaws are in the open position, the first clip can be fastened to the user's apparel. The second clip can likewise be squeezed or pinched and while in the open position a user's identification can be inserted. Upon release of the squeezing force the identification will be securely held.

In the embodiment illustrated in FIG. 3, upper gripping jaw 24 has a downwardly descending claw with internal cavity of gripping groove 42. Upper gripping jaw 24 has an inner gripping groove 38 and and outer gripping groove 40 for engaging the lower gripping jaw 26 which when together grips the clothing or identification item with a firm grip.

On the upper finger lever 18 preferably has finger lever gripping grooves 20 embedded on the upper surface of the finger lever. Gripping grooves 20 offer a non-slip grip which allows for additional ease when pinching open the respective jaws (24 and The pivotal axis 22 is preferably comprised of a ball joint 30 snapped into a cup shaped joint 32. When the clip is pinched open, the ball joint 30 rolls itself within the cup shaped joint 32 and in union the cup shaped point acts as a pivoting axis for the opening of the jaws.

SUMMARY, RAMIFICATIONS, AND SCOPE

The double ended clip of the present invention provides a holding device that is useful for attaching assorted types or sizes of identification to one's clothing. With its assortment of unique features—rotating clips, flexible base strip, and clips on opposite sides of a central base strap—the clip can be worn on any type of clothing both conveniently and attractively and is suitable for wear by men, women and children, and teenagers, The clip is designed such that the identification can immediately be attached to or removed from one clip and can simply and immediately be attached or detached from the user's clothing using the second clip. The rotating clips offer the wearer the option of determining the angle or direction the clip attaches to their clothing and the angle or direction that the identification is displayed. Additionally, because of the positioning of one clip on one side of the strap and the other clip on the other side of the strap (i.e. below the bottom or second surface), the identification lays flat against the wearer's body.

The base strap and clips can be comprised of various materials, for example, plastic material or polypropylene which can be made in a variety of colors. The clip can also be composed of other materials, i.e. metal.

The upper finger lever of the clip portion of the holding device is designed with a a specially treated surface so that the clips are not slippery when handled with wet or greasy fingers.

The invention is durable, easy to use, reusable, and accepts labeling or printing.

Although the description above contains many specifications, these should not be construed as limiting the scope of the invention but as merely providing illustrations of some of the presently preferred embodiments of this invention. For example, the double ended clip can have a base of other shapes or the clips can be replaced by other clamping type devices.

Thus the scope of the invention should be determined by the appended claims and their legal equivalents, rather than by the examples given.

I claim:

1. A holding device for securing identification to a wearer, said device comprising:

a base strap with a first surface and a second opposing surface and having a first end and a second opposing end;

a first clip means with pivotal axis operating with a ball and cup joint springlike hinge rotatably attached to the first surface of the base strap proximate to the first end of the base strap; and a second clip means with pivotal axis operating with a ball and cup joint springlike hinge rotatably attached to the second surface of the base strap proximate to the second end of the base strap.

* * * * *